United States Patent [19]

Beebe et al.

[11] Patent Number: 4,489,966

[45] Date of Patent: Dec. 25, 1984

[54] DOOR OR COVER LATCH AND LATCHING SYSTEM UTILIZING SAME

[75] Inventors: Emmett R. Beebe, Glenview; Edmund S. Dizon, Chicago; Arvydas J. Kalvaitis, Northbrook, all of Ill.

[73] Assignee: S&C Electric Company, Chicago, Ill.

[21] Appl. No.: 366,498

[22] Filed: Apr. 8, 1982

[51] Int. Cl.[3] ..... E05C 3/12

[52] U.S. Cl. ..... 292/334

[58] Field of Search ..... 292/332-336, 292/148; 70/74

[56] References Cited

U.S. PATENT DOCUMENTS

| | | | |
|---|---|---|---|
| 711,111 | 10/1902 | Kirk | 70/74 |
| 976,026 | 11/1910 | Beehler | 292/88 |
| 1,162,121 | 11/1915 | Wright et al. | 292/336 X |
| 1,864,306 | 6/1932 | Hope | 292/334 |
| 2,218,683 | 10/1940 | Miller | 292/26 X |
| 3,065,986 | 11/1962 | Barker et al. | 292/332 |

*Primary Examiner*—Richard E. Moore

*Attorney, Agent, or Firm*—Kirkland & Ellis

[57] ABSTRACT

A latch for a door or cover associated with a wall or enclosure. A movable latch arm on the door or cover is spring biased to engage a projection on the wall or enclosure when the door or cover is closed. A blocking member on the door or cover is biased for movement into the path of movement of the arm to prevent its engagement of the projection. With the door or cover closed, the projection holds the blocking member out of the arm's path. Movement of the arm to disengage the projection and coupled with opening of the door or cover to separate the projection and the blocking member, results in the blocking member blocking the arm. Reclosure of the door or cover results in the blocking member being held out of the path of the arm which automatically re-engages the projection. The arm and the blocking member may be on the wall or enclosure and the projection may be on the door or cover. The latching system may include two or more projections, blocking members and arms, and the latter may be commonly movable. A latching system may also include facilities which prevent insertion of a lock shackle into a locking staple, which passes through the closed door, if the projection (or all projections) is not engaged by the arm (or arms).

26 Claims, 25 Drawing Figures

FIG-4
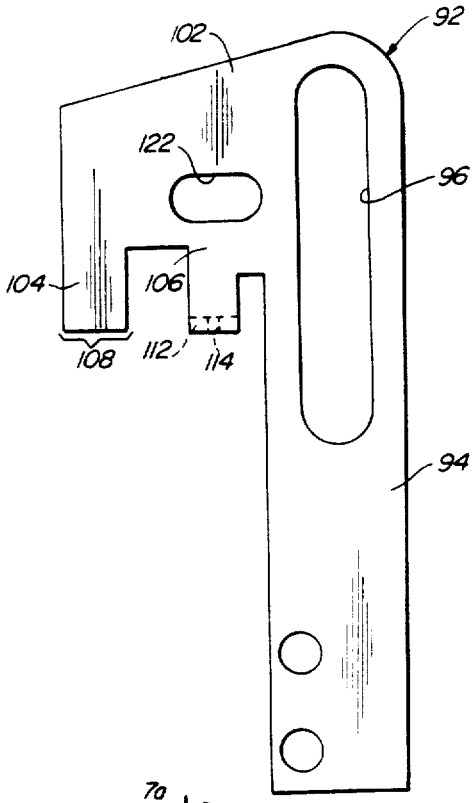
FIG-4a
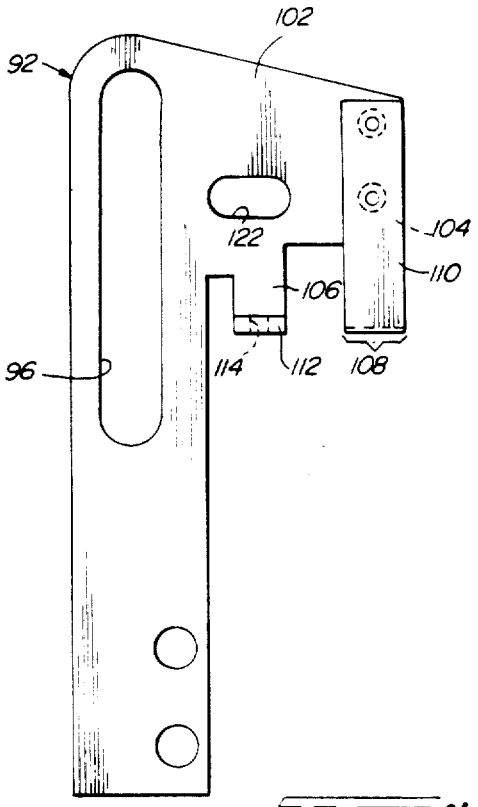
FIG-4b
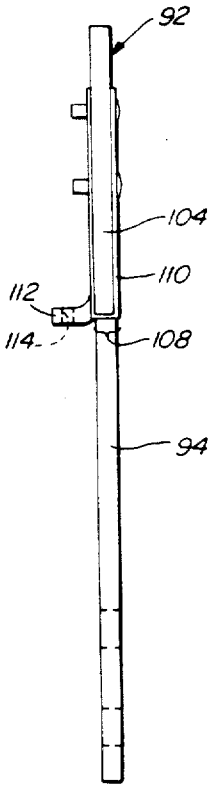
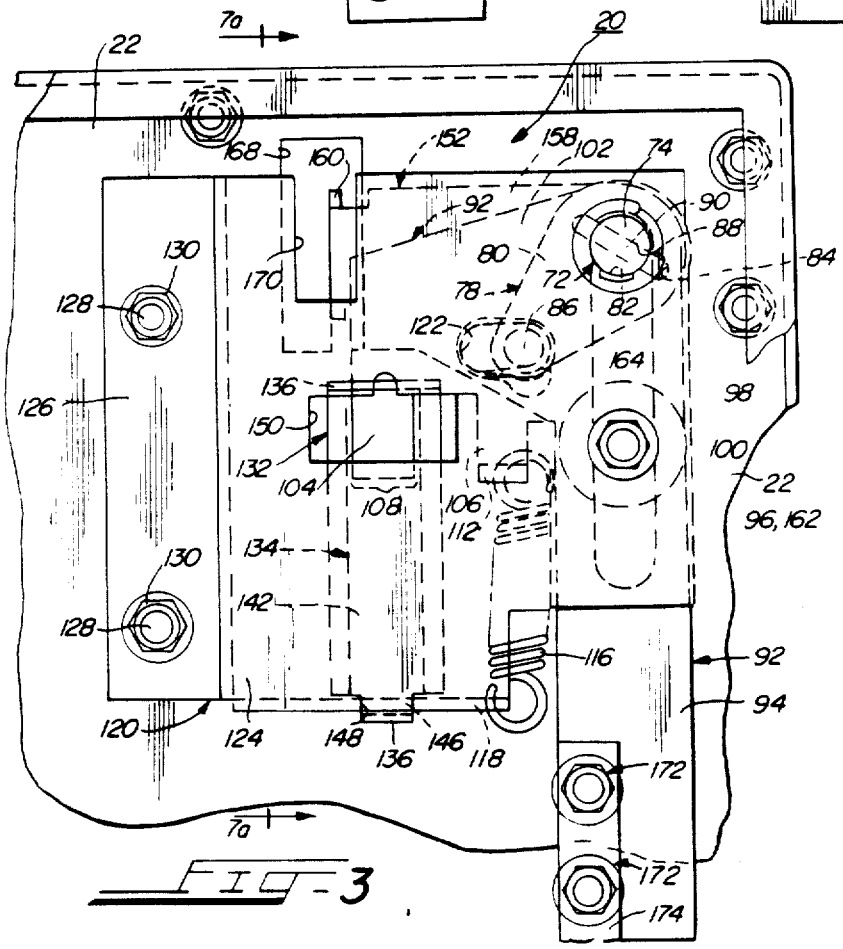
FIG-3

DOOR OR COVER LATCH AND LATCHING SYSTEM UTILIZING SAME

BACKGROUND OF THE INVENTION

1. Field of the Invention

The present invention relates to a latch for a door or cover and to latching systems utilizing the latch. More specifically, the present invention relates to an improved latch for a door or cover of an enclosure which positively latches the door or cover in the closed position and which informs a worker manipulating the door or cover whether or not the door or cover is fully closed and capable of being locked to prevent access to equipment contained within the enclosure. The present invention also contemplates latching systems utilizing either the novel latch and facilities which prevent locking the door or cover unless such is fully closed and latched, or a plurality of the novel latches, or both. The latch and latching systems utilizing the latch are constructed to prevent or obviate unauthorized opening or removal of the door or cover and tampering with the door or cover and the latch by vandals.

2. Brief Description of the Prior Art

Numerous latches and latching systems for doors or covers on enclosures are known. See, for example, commonly-assigned U.S. Pat. Nos. 3,055,996 and 3,572,062. When the enclosure contains or includes apparatus, unauthorized access to which should be limited or prevented, it is important that any latch or latching system for the enclosure door or cover be positive in action and more or less "force" a worker to ensure that the door or cover is properly latched and locked in place.

Desirable features of latches and latching systems include ease of manipulation in latching or unlatching the door or cover and preventing the locking of the latch or of the door or cover if such is not first properly latched. Other desirable features include "vandal-proofing" whereby unauthorized operation of, or tampering with, the latch or any lock associated therewith is prevented or obviated, and limiting the class of personnel which is able to manipulate the latch, whether it is locked or not.

The inclusion of all of the above desirable features in a latch and in a latching system is an object of the present invention.

SUMMARY OF THE INVENTION

With the above and other objects in view, the present invention relates to an improved latch for holding a door or cover closed. The door or cover is movable toward and away from an area between a closed position and an opened position. In its closed position, the door or cover is adjacent to the area and renders the area inaccessible. In its opened position, the door or cover is remote from the area and renders the area accessible. The area may be an opening through a wall, which may constitute a portion of an enclosure. When the door or cover is closed, it overlies the opening, and access through the opening to the interior of the enclosure is prevented. The area may also be a portion of a wall or other surface which contains items such as switches, controls, locks or the like. When the door or cover is closed, it overlies the items and access thereto is prevented. Whether the area is an opening through a wall or a portion of a wall, the door or cover may be hinged at one edge to the wall or to a door frame for movement on hinges between its closed and opened positions. Also, regardless of the nature of the area, the door or cover may be entirely movable away from and disassociated from the wall along the lines of a removable cover plate.

In one preferred embodiment, a stationary projection is mounted in or near the area. The projection may be mounted to the wall or to a door frame. The projection is adjacent to the door or cover at a latching site thereof when the door or cover is closed. The projection is remote from the door or cover and the latching site when the door or cover is opened. The latching site, which may coincide with or be separated from the area overlain by the door or cover when it is closed, is the region where the door or cover is latched closed.

An arm is mounted to the door or cover for movement toward and away from the latching site to respectively engage and disengage the projection when the projection is located at the latching site. Engagement of the projection by the arm holds the door or cover closed. Disengagement of the projection by the arm frees the door or cover for movement to its opened position. The arm is biased for movement toward the latching site. Facilities selectively move the arm against the biasing means away from the latching site. A movable blocking member is biased for movement to a first position where the arm is blocked from movement toward the latching site. The blocking member is held out of its first position by the projection when the projection is located at the latching site. The blocking member moves to its first position if the projection is not at the latching site—as occurs if the door or cover is opening or is fully opened—and if the arm has also moved away from the latching site. Thus, after the arm has disengaged the projection and the door or cover has been opened, the arm is held away from the latching site by the blocking member. Upon closure of the door or cover, the projection moves the blocking member out of the path of the arm which thereafter re-engages the projection, positively latching the door or cover closed.

In a second preferred embodiment, the projection is mounted to the door or cover. When the door or cover is closed, the projection is adjacent the area and is located at a latching site thereof. When the door or cover is opened, the projection is remote from the area and from the latching site. An arm is mounted in the area—typically to the wall or to a door frame—for movement toward and away from the latching site to respectively engage and disengage the projection when the projection is located at the latching site. The arm is biased for movement toward the latching site. Also included are moving facilities for the arm and a blocking member which function as in the first embodiment.

A latching system may be constructed using either of the above-described embodiments of the latch of the present invention by providing a plurality of latching sites, projections, arms, and blocking members. In this event, it is preferred that facilities be provided for moving each arm in common.

Regardless of whether a single latch or a latching system containing a plurality of latches is used, additional embodiments of the present invention include facilities which permit locking the door or cover and the latch. Specifically, a locking staple on the wall or door frame protrudes through a passageway in the door or cover and therebeyond when the door or cover is closed. When the locking staple so protrudes through the passageway, it may receive a shackle of a lock therein. The door or cover functions as a hasp when it is closed and a lock shackle is received in the locking staple. Facilities may be provided which respond to the blocking of the arm (or to the blocking of any arm if plural latches are used) by its blocking member to prevent the reception of a lock shackle by the locking staple. The preventing facility may also prevent movement of the arm (or arms) away from its latching site—and thereby prevent disengagement of the projection—if a lock shackle is received by the locking staple when the door or cover is closed. The preventing facility may include a tab adjacent to, and alignable with, the locking staple when the door is or cover closed. When aligned, the tab and the locking staple may simultaneously receive a lock shackle therein. Facilities are provided for interconnecting the tab and the arm-moving facility so that the tab is moved out of alignment with the adjacent locking staple when the arm (or arms) is moved away from its latching site. The lack of alignment between the tab and the locking staple prevents reception of a lock shackle by either of these members while they are adjacent. The tab remains out of alignment with the locking staple if the arm (or any arm) is blocked by its blocking member.

In yet additional preferred embodiments, the arm (or arms) is moved by facilities which include a tool-engageable member on the door or cover. The tool-engageable member is accessible when the door or cover is closed; manipulation of a tool which engages the member selectively moves the arm. Preferably, the portion of the tool-engageable member accessible from the front of the door or cover is a polygon, which is engageable and rotatable by a similarly configured socket. The polygonal portion may be recessed within a well defined by a cylinder and engageable by the socket when the socket is inserted into the well. The vertices of the polygonal portion may be spaced sufficiently close to the walls of the cylinder such that a dissimilarly configured socket is unable to fit into the well and engage the polygonal portion. Further, the recessing of the polygonal portion prevents grasping or manipulation thereof with other tools, such as pliers or the like. In this fashion, manipulation of the polygonal portion of the tool-engageable member by other than a complementary socket is rendered difficult, if not prevented.

In further embodiments, a pocket is attached to the front surface of the door or cover. The pocket contains the blocking tab, the cylinder, and (when the door is closed) the locking staple. The pocket is configured so that a lock and its shackle may be inserted from the underside thereof and associated with the blocking tab and the locking staple when the door is fully closed and the arm (or arms) engages its projection. In this way, the blocking tab, the locking staple and the cylinder are protected from the elements; also insufficient space is provided between the door and the pocket to grasp or otherwise tamper with the shackle of an emplaced padlock.

BRIEF DESCRIPTION OF THE DRAWING

FIG. 3 is an enlarged partial rear elevation of the portion of the latch depicted in FIG. 2;

FIGS. 4, 4*a*, and 4*b* are, respectively, a rear elevation, a front elevation, and a side elevation of a latch slide forming a portion of the latch shown in FIGS. 1–3;

DETAILED DESCRIPTION

Figure 1:
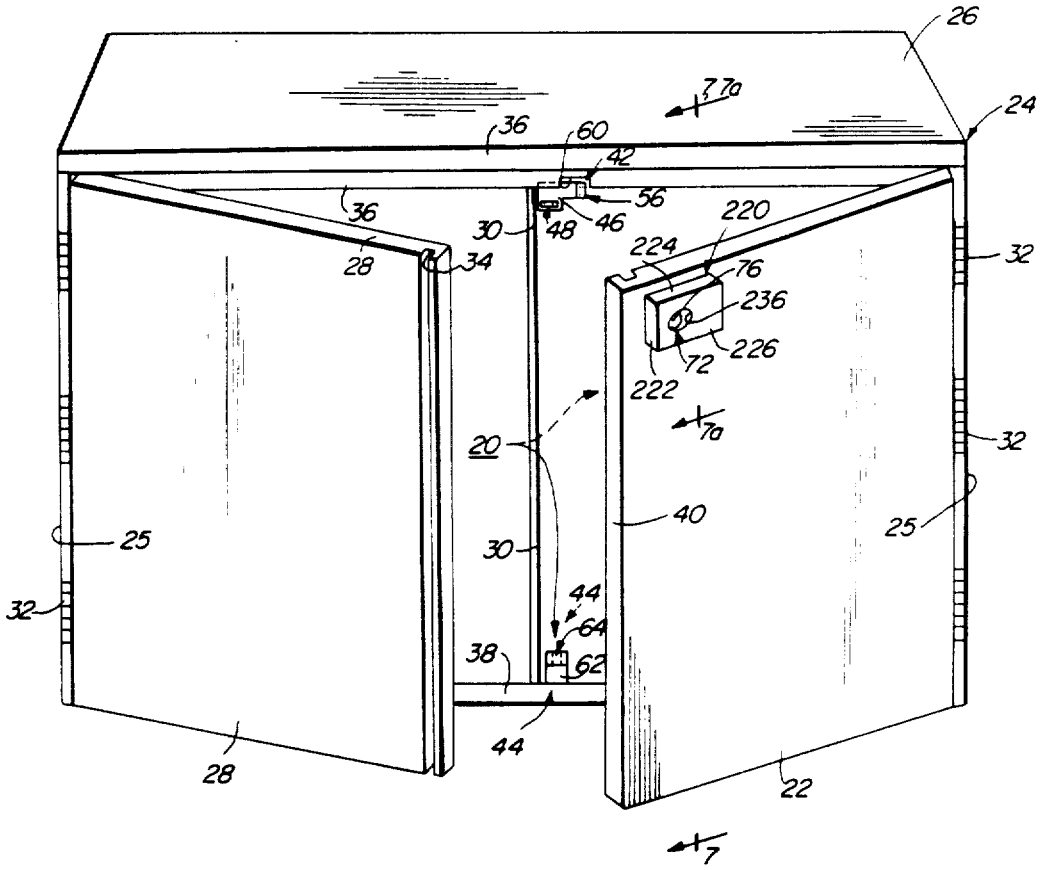
FIG. 1 is a perspective view of a walled enclosure having doors, one of which utilizes the latch of the present invention.

Referring first to FIG. 1, a latch 20 according to the present invention is shown in use on a door 22 of an enclosure 24. The enclosure 24 may contain high-voltage electrical gear, such as switches, fuses, arrestors and busses (not shown), and may comprise a plurality of side walls 25 covered by a roof 26. Access to the interior of the enclosure 24 may be gained by opening the door 22 and an adjacent door 28. The enclosure 24, the roof 26, and the doors 22 and 28 are preferably made of a heavy gauge metal, such as steel, when the enclosure 24 houses electrical gear. It is, of course, not necessary that the enclosure 24 or any of its components be made out of metal, just as it is not necessary that the enclosure 24 house electrical gear. Also, although two doors 22 and 28 are shown, the latch 20 of the present mechanism may be conveniently used when only one door, such as the door 22, is present. Moreover, the latch 20 may be used on a cover (not shown) rather than on the door 22. In this event, the closed cover may function to contain and prevent access to a switch, a handle, a lock and hasp arrangement, or the like on the exterior of the enclosure 24 or other walled structure. The cover need not be hinged to the enclosure 24 and may be along the lines of a removable cover plate.

Where the enclosure 24 houses electrical gear, its interior may be divided into two physically separated compartments by a dividing wall 30 which is visible when the doors 22 and 28 are open. Each door 22 and 28 is rotatably mounted at one edge thereof to the enclosure 24 by hinges 32 of any convenient style. Thus, the doors 22 and 28 may be rotated between a closed position, wherein they prevent access to the interior of the enclosure 24, and an open position, wherein access to the enclosure 24 is permitted. Whether the latch 20 is used on the door 22 or on the cover (not shown), either may be associated with the enclosure 24 without the use of the hinges 32. Specifically, the door 22 or the cover (not shown) may be of the type which is adjacent to the enclosure 24 or one of its walls 25 when closed and which is wholly removed from the enclosure 24 or the wall 25 when opened. Such may be achieved by latching the door 22 or the cover (not shown) to the enclosure 24 at plural locations, by separable hinges or by similar structure.

In FIG. 1, the latch 20 of the present invention need be associated only with the door 22 and a similar latch need not be associated with the door 28. This need for only a single latch 20 with the door 22 may be achieved by appropriate configuration of the doors 22 and 28. Specifically, at or near the free edge of the door 28 remote from its hinge 32, a vertical groove or elongated depression 34 is formed. The groove or depression 34 may extend from the entire height of the door 28. When the door 28 is closed, its top and bottom abut upper and lower structural members 36 and 38 of the enclosure 24. The edge of the door 22 remote from its hinge 32 may include a projecting portion 40. If the door 28 is closed first so that it abuts the upper and lower members 36 and 38, and the door 22 is then closed, the projecting portion 40 is moved into the groove or depression 34. The latch 20 of the present invention maintains the door 22 in its closed position, as described in detail below, maintaining its projecting portion 40 in the groove or depression 34. Thus, the holding closed of the door 22 by the latch 20 also maintains the door 28 in its closed position. If desired, a screw or other fastener (not shown) may pass through the free edge of the door 28 and be selectively associated with or disassociated from a mating member (not shown) mounted or attached to the dividing wall 30. If this expedient is used, when the door 22 is held closed by the latch 20, the door 28 is held closed both by the location of the projection portion 40 in the groove or depression 34 and by the association of the screw with its mating member.

In preferred embodiments described herein, the latch 20 of the present invention holds the door 22 closed at two points. One point is near the top of the door 22, while the other point is near the bottom of the door 22. As described in more detail below, the door 22 may be held in the closed position at only one point or at three or more points, as desired. The same is true where the door 22 or cover (not shown) is, when opened, wholly removed from the enclosure 24 by means of removable hinges or the like.

The foward edge of the right-hand side wall 25, the dividing wall 30, and the upper and lower members 36 and 38 constitute a door frame for the doors 22 and 28. The door frame 25, 30, 36, 38 defines an opening into the interior of the enclosure 24. This opening is rendered inaccessible when the door 22 is adjacent thereto in its closed position and is rendered accessible when the door 22 is remote therefrom in its opened position. In the event the latch 20 is used with the removable cover (not shown), a portion of the enclosure 24 or one of the walls 25 thereof is rendered either accessible or inaccessible, depending on the cover's position, opened or closed. In the claims hereof, the word "area" is used to denote the opening defined by the door frame 25, 30, 36, 38, the portion of the enclosure 24 or one of its walls 25, or any other region rendered accessible or inaccessible by the door 22 or the cover (not shown).

Figure 9A:
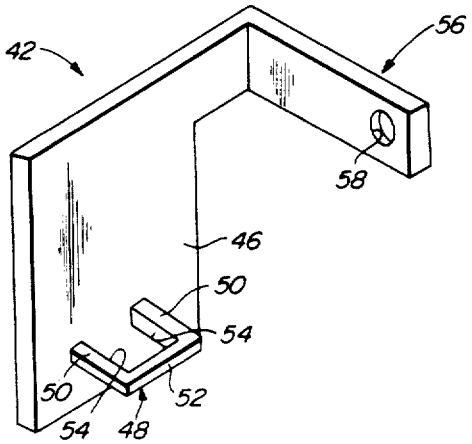
FIGS. 9*a* and 9*b* are perspective views of, respectively, an upper latch engageable member and a lower latch engageable member which form a portion of the latch of the present invention.
Figure 9B:
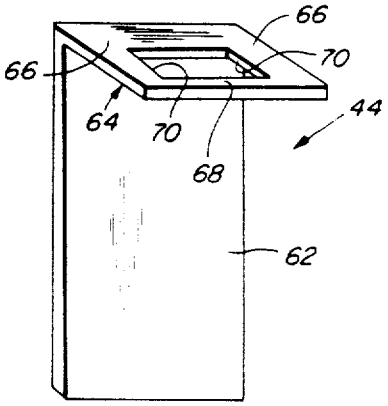

Mounted to the top and the bottom of the door frame 25, 30, 36, 38 are respective projections or latch-engageable members 42 and 44. Referring to FIGS. 1, 7 and 9*a*, the upper latch-engageable member 42 may include a metal plate 46 attached to the door frame 25, 30, 36, 38 by welding it to the rear surface of the upper member 36, as shown in FIG. 1, or to the side of the dividing wall 30. Attached to the plate 46 and projecting outwardly away from the interior of the enclosure 24 is a projecting member 48 which may be U-shaped and include a pair of generally parallel legs 50 with an interconnecting portion 52 therebetween. The legs 50, the interconnecting portion 52, and the front surface of the plate 46 define an aperture 54 (see FIG. 9*a*) into which a portion of the latch 20 may be inserted to hold the top of the door 22 in its closed position.

Attached to or forming a part of the plate 46 may also be a locking staple 56. See FIGS. 1, 2, 7, 7*a* and 9*a*. The locking staple 56 is a member projecting away from the interior of the enclosure 24 generally parallel to the projecting member 48 having a hole 58 therethrough for the reception therein of a lock shackle, as described below. To accommodate the outward projection of the locking staple 56 where the plate 46 is mounted to the door frame 25, 30, 36, 38 behind the upper member 36, such upper member 36 may have a cutaway portion 60 through which the locking staple 56 protrudes.

Referring to FIGS. 1, 7, 9*b*, 10*a* and 10*b*, the lower latch engageable member 44 may comprise two portions 62 and 64, which are integrally formed or attached together at right angles. As shown in FIG. 1, the portion 62 is attached to the door frame 25, 30, 36, 38 by connection thereof to the lower member 38 in any convenient fashion. The portion 64 projects away from the interior of the enclosure 24 generally parallel to the projecting member 48 and the locking staple 56. The portion 64 is similar to the projecting member 48 and may include parallel legs 66 joined together by an interconnecting portion 68 so that the portion 64 is U-shaped. The surface of the portion 62, the legs 66, and the interconnecting portion 68 define an aperture 70 into which a portion of the latch 20 may be inserted for holding the bottom of the door 22 in its closed position.

Figure 2:
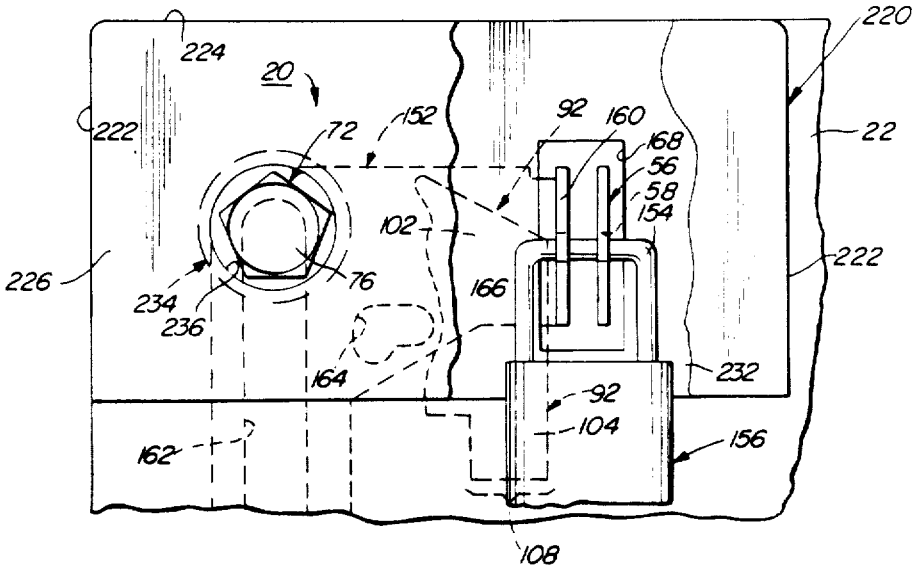
FIG. 2 is an enlarged partial front elevation of a portion of the latch of the present invention showing in greater detail certain features thereof.
Figure 6:
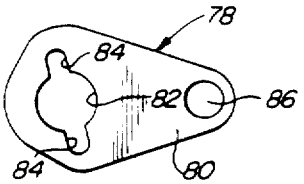
FIGS. 6 and 6*a* are, respectively, a front elevation and a top view of a drive lever forming a portion of the latch depicted in FIGS. 1–3.
Figure 6A:
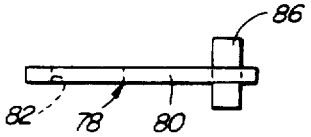
Figure 7:
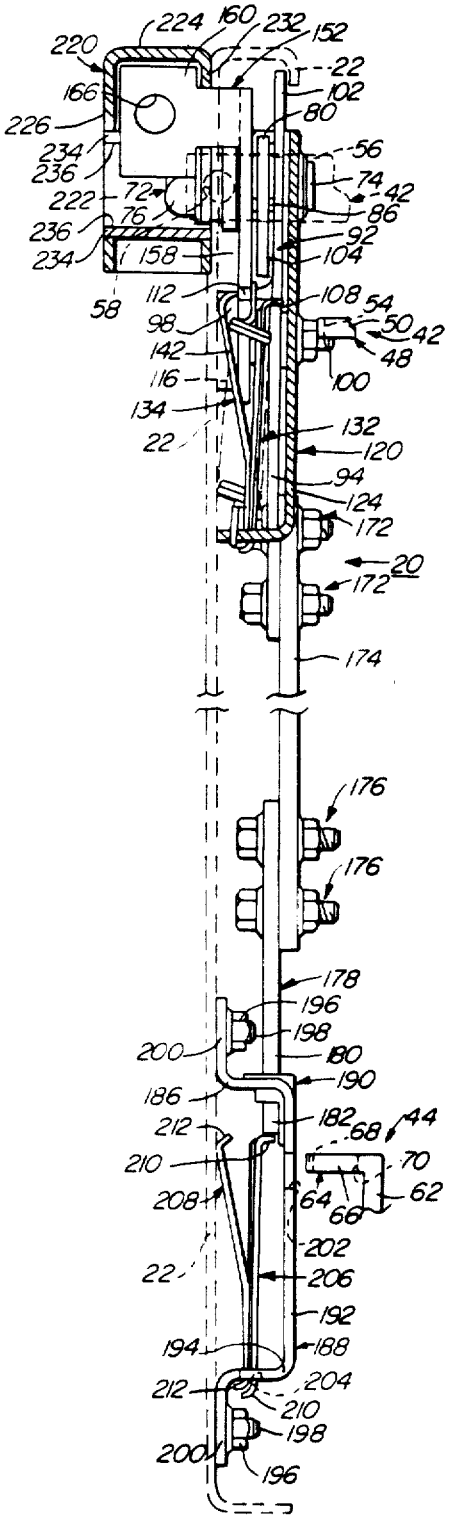
FIG. 7 is a partially sectioned, side elevation of one door of the enclosure of FIG. 1 depicting in detail certain features of the latch of the present invention and taken along line 7—7 in FIG. 1.
Figure 8:
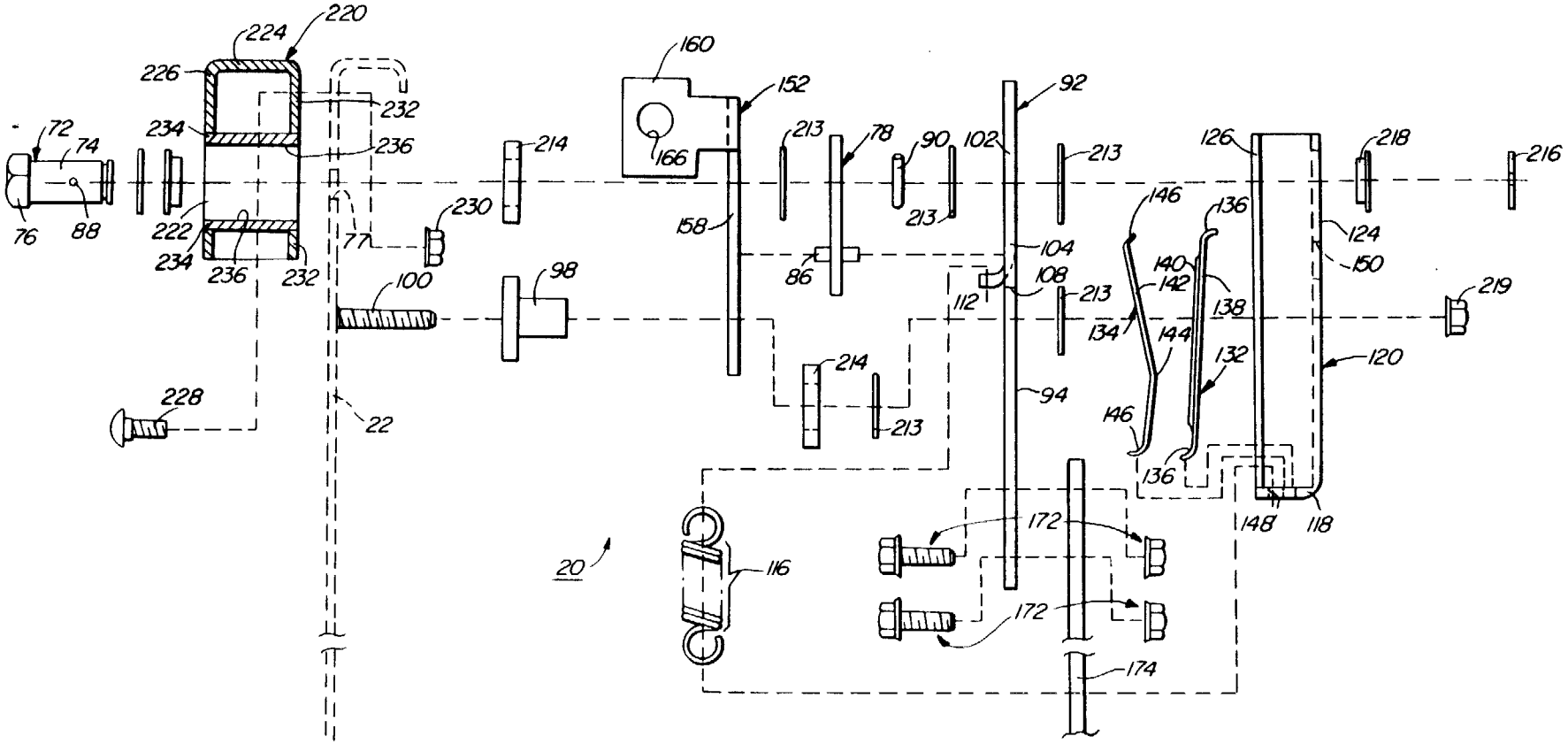
FIG. 8 is an exploded view of the portion of the latch according to the present invention as depicted in FIG. 7*a*.

Turning now to FIGS. 2 and 3, certain details of the latch 20 are described. The latch includes a drive member 72 which preferably takes the form of a drive shaft 74 having a polygonal head 76 at one end thereof. As discussed in more detail below, the polygonal head 76 is accessible from the front surface of the door 22 for operation of the latch 20. See also FIGS. 1, 7 and 8. The drive shaft 74 rotatably passes through a hole 77 in the door 22 (FIG. 8) and has connected thereto a drive lever 78 which overlies the rear surface of the door 22. Referring to FIGS. 3, 6 and 6*a*, the drive lever 78 includes a main lever portion 80 having a hole 82 therethrough. Contiguous with the hole 82 on a diameter thereof are elongated slots 84. Fixed to and protruding from either side of the main lever portion 80 is a drive pin 86. Referring to FIGS. 3 and 8, the drive lever 78 is mounted to the drive shaft 74 by placing the hole 82 over the drive shaft 74 and positioning the main lever portion 80 so it is coplanar with a bore 88 (see FIG. 8)

formed through the drive shaft 74. The bore 88 holds a pin 90 which extends away from both ends thereof and fits into the slots 84, thus locking the drive lever 78 to the drive shaft 74. Rotation of the polygonal head 76 at the front surface of the door 22 rotates the drive shaft 74 to rotate the drive lever 78 and the drive pin 86 at the rear surface of the door 22.

Referring to FIGS. 2, 3, 4, 4*a*, 4*b*, and 8, the latch 20 includes a latch slide 92. The latch slide 92 comprises an elongated portion 94 which is generally vertically oriented in FIG. 3. The elongated portion 94 includes a vertical, elongated slot 96. The elongated slot 96 has a width sufficient to permit both the drive shaft 74 and the body of a bushing 98 (see also FIG. 8) to be received therein. The bushing 98 surrounds a threaded stud 100 mounted to the rear surface of the door 22. The threaded stud 100 is located below the location of the passage of the drive shaft 74 through the door 22. The length of the slot 96 is such that, in the lowermost position of the latch slide 92, the top of the slot 96 engages the drive shaft 74 and the bushing 98 is positioned above the bottom of the slot 96 so that the latch slide 92 may experience limited upward sliding motion. In sliding upwardly and downwardly, the latch slide 92 is vertically guided by the engagement between the drive shaft 74 and the bushing 98 with the slot 96.

As viewed in FIGS. 3 and 4, the latch slide 92 also includes a projection 102 formed integrally with the portion 94. Depending from the projection 102 are a pair of fingers 104 and 106. The lower end of the finger 104 comprises a latch arm 108 which may be covered with a wear-resistant sole plate 110, shown only in FIGS. 4*a* and 4*b*. The finger 106 includes a turned-out portion 112 which projects into the plane of FIG. 3. The turned-out portion 112 has a hole 114 (FIGS. 4, 4*a* and 4*b*) into which is hooked one end of an extension spring 116. The other end of the extension spring 116 is connected to a lower flange 118 of a latch cover plate 120 or other housing which covers a portion of the latch 20 and is mounted to the rear surface of the door 22. The latch cover plate 120 is described in greater detail below.

The characteristics of the extension spring 116 are such that the spring 116 biases the latch slide 92 toward the lowermost position depicted in FIG. 3. If the latch slide 92 is moved upwardly against the bias of the spring 116 (as in FIGS. 7 and 7*a*), the elongated extension spring 116 biases the latch slide 92 back toward the position depicted in FIG. 3.

The projection 102 of the latch slide 92 carries a slot 122 elongated in a direction normal to the slot 96. One end of the drive pin 86 projects into the slot 122. Rotation of the drive shaft 74 rotates the drive lever 78 and the drive pin 86 about the axis of the drive shaft 74. Assuming such rotation to be clockwise, as viewed in FIG. 3 (counterclockwise in FIG. 2), the rotation of the drive pin 86 acts on the walls of the slot 122, moving the latch slide 92 upwardly against the bias of the extension spring 116. By the same token, if the extended spring 116 is able to move the latch slide 92 from an upward position (FIG. 2) to its lowermost position (FIG. 3), the action of the walls of the slot 122 on the drive pin 186 rotates the drive pin 186, the drive lever 78 and the drive shaft 74 counterclockwise, as viewed in FIG. 3 (clockwise in FIG. 2).

Referring again to FIG. 3 and also to FIG. 8, the latch cover plate 120 comprises a plate-like member 124 having a side flange 126 integrally formed therewith. The cover plate 120 is mounted to the rear surface of the door 22 by placing a pair of holes (not shown) in the side flange 126 over a pair of spaced, threaded studs studs 128 mounted to the rear surface of the door 22 (FIG. 3) and then running nuts 130 over the threaded studs 128. The lower flange 118 of the cover plate 120 is integrally formed with the plate-like member 124. As shown in FIG. 3, the cover plate 120 covers the upper portion of the latch 20 of the present invention.

Referring to FIGS. 3 and 8, the latch 20 also comprises a latch block 132 and a latch spring 134. See also FIGS. 7 and 7*a*. The latch block 132 is a rigid, robust elongated metal member which is essentially straight and the ends of which are oppositely turned outwardly to form hooks 136. The latch block 132 may include a substantially planar member 138 having a strenghtening rib 140 on one surface thereof. See FIGS. 3, 7*a* and 8. The strengthening rib 140 serves to prevent the planar member 138 from flexing. The latch spring 134 comprises a leaf spring-like member 142 having a bend 144 at or near its midpoint. The free ends of the latch spring 134 are oppositely turned outwardly into hooks 146.

Figure 7A:
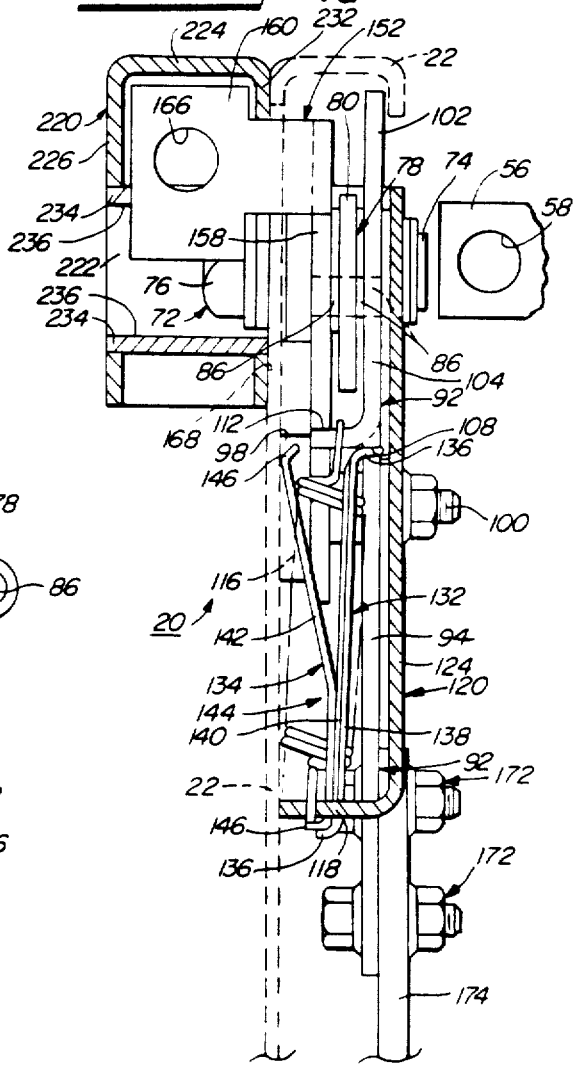
FIG. 7*a* is an enlarged view of an upper portion of the latch of FIG. 7 taken generally along lines 7*a*–7*a* in FIGS. 1 and 3.

As shown in FIGS. 3, 7*a* and 8, one hook 136 on the latch block 132 and one hook 146 on the latch spring 134 are inserted into an aperture 148 formed through the flange 118 of the cover plate 120. The hooks 136 and 146 are so inserted into the aperture 148 that, as viewed in FIGS. 7*a* and 8, both the latch block 132 and the latch spring 134 have S-like configurations. The hook 136 on the end of the latch block 132 is inserted into the aperture 148 so that the strengthening rib 140 faces the rear surface of the door 22. The hook 146 on the latch spring 134 is inserted into the aperture 148 so that the hook 136 overlies the hook 146 and the latch spring 134 is maintained between the strengthening rib 140 of the latch block 132 and the rear surface of the door 22. The hook 146 at the free end of the latch spring 134 is held out of its natural position by abutment with the rear surface of the door 22. The lower terminus of the rib 140 rests on the top surface of the flange 118 to prevent the latch block 132 and the latch spring 134 from falling out of the aperture 148. Further, the latch spring 134 is shaped so that it exerts a bias force on the latch block 132 which tends to move the latch block 132 away from the rear surface of the door 22 and toward the path of movement of the latch arm 108.

Referring to FIGS. 7 and 7*a*, if the drive shaft 74 has been rotated clockwise (as viewed in FIG. 3) to move the latch arm 108 upwardly, the latch spring 134 has moved the latch block 132 away from the rear surface of the door 22. Such movement of the latch block 132 has positioned the hook 136 at the free end thereof in the path of and beneath the latch arm 108. As a consequence, the extension spring 116 is unable to move the latch slide 92 to the lowermost position depicted in FIG. 3. This inability of the extension spring 116 to move the latch slide 92 downwardly continues until appropriate action occurs, as described below, which action moves the latch block 132 out of the path of the latch arm 108 against the bias of the latch spring 134.

Returning to FIG. 3, the plate-like member 124 of the cover plate 120 contains an opening 150 which is aligned with the top of the latch block 132 near the free end thereof. The opening 150 is positioned so that when the door 22 is closed—that is, is rotated toward the door frame 25, 30, 36, 38—the projecting member 48 passes through the opening 150. Assuming the latch arm 108 and the latch block 132 to be in the positions depicted in FIGS. 7 and 7a, the passage of the projecting member 48 through the opening 150 ultimately brings the projecting member 48 into contact with the latch block 132. Further movement of the door 22 toward its fully closed position causes yet further entry of the projecting member 48 through the opening 150 and, ultimately, moves the latch block 132 toward the rear surface of the door 22 and out of the path of the latch arm 108. As the hook 136 at the free end of the latch block 122 moves out of the path of the latch arm 108, the extension spring 116 moves the latch slide 92 downwardly. Downward movement of the latch slide 92 moves the latch arm 108 downwardly so that it enters and passes through the aperture 54 defined by the projecting member 48 and the plate 46. Entry of the latch arm 108 into the aperture 54 latches the top of the door 22 in the enclosed position. To unlatch the top of the door 22 for opening movement out of the closed position, it is necessary to rotate the drive shaft 74 clockwise, as viewed in FIG. 3 (counterclockwise in FIG. 2) to lift the latch arm 108 out of the aperture 54. After a sufficient amount of rotation of the drive shaft 74, the latch arm 108 is removed from the aperture 54 and is removed from the path of movement of the hook 136 at the free end of the latch block 132. If this is followed by removal of the projecting member 48 from the opening 150, the latch spring 134 again biases the latch block 132 into a position wherein the hook 136 at its free end moves beneath and blocks movement of the latch arm 108.

The general location where the latch arm 108 engages the projecting member 48 and where that member 48 moves the latch block 132 out of the path of the latch arm 108 is referred to in the claims thereof as a "latching site." as can be seen, this latching site also includes the opening 150 in the latch cover plate 120 and is generally associated with, and moves with, the door 22. As will be seen below, other embodiments contemplate location of the latching site at the frame 25, 30, 36, 38 or elsewhere near or adjacent to the area rendered accessible or inaccessible by the door 22.

Overly "careful" manipulation (clockwise rotation as viewed in FIG. 3) of the drive shaft 74 may permit removal of the latch arm 108 from the aperture 54 without moving the latch arm 108 sufficiently out of the path of the hook 136 at the free end of the latch block 132 to permit the latch spring 134 to move the latch block 132 away from the rear surface of the door 22, even if the projecting member 48 is fully withdrawn from the opening 150. If the drive shaft 74 is held in this position, the top of the door 22 is freed for opening and may be moved away from the door frame 25, 30, 36, 38. If, after such opening movement of the door 22, the drive shaft 74 is rotated yet further in a clockwise direction, as viewed in FIG. 3, the latch block 132 will be moved away from the rear surface of the door 22 into the path of the latch arm 108, as described above. If, however, after this "careful" manipulation of the drive shaft 74, the extension spring 116 is permitted to move the latch slide 92 downwardly, the latch arm 108 returns to its position behind the opening 150 in the cover plate 120 and blocks movement of the hook 136 on the latch block 132 out of the position shown in FIG. 3. A subsequent attempt to close and latch the door 22 without manipulation of the drive shaft 74 will prove unsuccessful. Specifically, with the latch arm 108 in its lowermost position and the door 22 open, rotation of the door toward its closed position will ultimately result in abutment between the finger 104 and the interconnecting portion 52 of the projecting member 48. This abutment will prevent further closing movement of the door 22 until the drive shaft 74 is rotated a sufficient amount in a clockwise direction, as viewed in FIG. 3, to lift the latch arm 108 and its finger 104 out of the path of movement of the projecting member 48 through the opening 150. This further manipulation of the drive shaft 74 may or may not result in the hook 136 at the free end of the latch block 132 from moving into the path of movement of the latch arm 108. Whether or not such occurs is unimportant since, under the assumption made, the door 22 will, following clockwise rotation of the drive shaft 74 as viewed in FIG. 3, be fully closed, and the projecting member 48 will, in this condition, move the latch block 132 toward the rear surface of the door 22 and out of the path of movement of the latch arm 108. Accordingly, the extension spring 116 moves the latch slide 92 downwardly, and the latch arm 108 enters the aperture 54.

Thus, as may be seen, the latch 20, as thus far described, permits positive latching of the upper end of the door 22 in its closed position. Unlatching of the door 22 to permit its movement to an open position requires manipulation of the drive shaft 74. If the manipulation of the drive shaft 74 is sufficient to permit the latch block 132 to hold the latch arm 108 in its uppermost position, the latch arm 108 will remain in its uppermost position until the door 22 is again fully reclosed, at which point the latch arm 108 automatically engages the aperture 54 in the projecting member 48, relatching the door 22 in its fully closed position. If, on the other hand, the door 22 is permitted to move to its open position upon just a sufficient amount of manipulation of the drive shaft 74 to withdraw the latch arm 108 from the aperture 54 without permitting the latch block 132 to hold the latch arm 108 in its uppermost position, unlatching of the door 22 is achieved and the door 22 may be moved. However, upon attempting to reclose the door 22, further manipulation of the drive shaft 74 is necessary because, absent this further manipulation, the finger 104 engages the projecting member 48 and prevents full closure of the door 22.

The structure and operation described in the proceeding paragraph is intended to "force" a worker to fully close and latch the door 22. Specifically, if, upon unlatching and opening the door 22, the drive shaft 74 is sufficiently manipulated, closure of the door 22 automatically results in full positive latching thereof. On the other hand, if opening of the door 22 is achieved through less than full manipulation of the drive shaft 74, the worker will be unable to fully reclose and latch the door 22 until the drive 74 is further manipulated.

Figure 5:
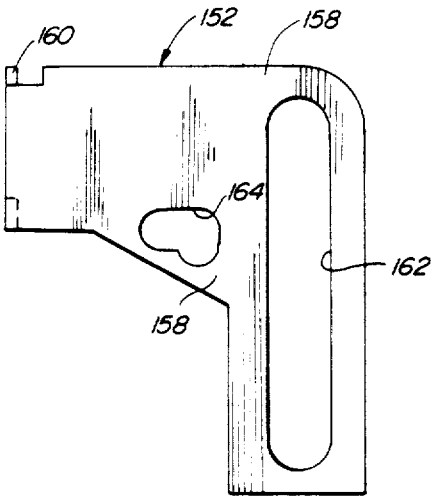
FIGS. 5, 5*a* and 5*b* are, respectively, a rear elevation, a front elevation, and a side elevation of a blocking tab which forms a part of the latch of FIGS. 1–3.
Figure 5A:
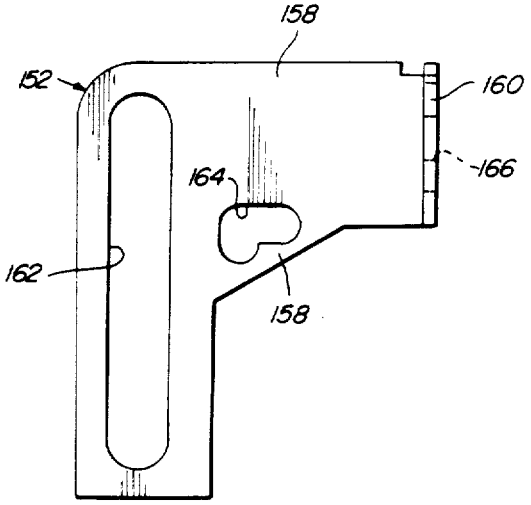
Figure 5B:
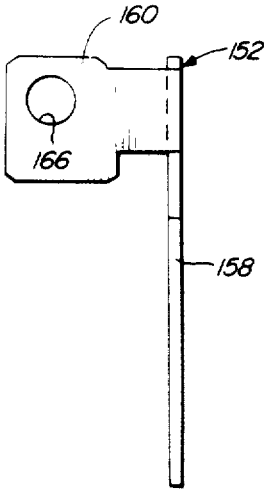

Returning to FIG. 3, and referring also to FIGS. 2, 7, 7a and 8, the latch 20 also includes a blocking tab 152. The function of the blocking tab 152 is to prevent a shackle 154 of a padlock 156 (FIG. 2) from being associated with the locking staple 56 to lock the door 22 unless the door 22 has been latched in its fully closed position. Referring additionally to FIGS. 5, 5a and 5b, the blocking tab 152 comprises a first planar portion 158 and a second planar portion 160, which is attached to or formed integrally with the first planar portion 158 at right angles thereto. As viewed in FIGS. 3, 5, and 5a, the first planar portion 158 of the blocking tab 152 contains an elongated slot 162. This elongated slot 162 has a configuration similar to the elongated slot 96 in the latch slide 92. The first planar portion 158 also includes an L-shaped slot 164 having two portions 164a and 164*b*. The slot portion 164*a* is generally elongated in a direction normal to the elongation of the slot 162, and has approximately the same size as the slot 122 in the latch slide 92. The slot portion 164*b* is normal to the portion 164*a* and parallel to the slot 162. The second planar portion 160 of the blocking tab 152 contains a hole 166 (FIGS. 5*b*, 7, 7*a* and 8) which, as will be described in detail below, is intended to accommodate the shackle 154 of the padlock 156. As viewed in FIGS. 3 and 8, the elongated slot 162 in the blocking tab 152 is positioned about the drive shaft 74 so that the first planar portion 158 is located between the rear surface of the door 22 and the drive lever 78 with the latch slide 92 on the other side of the drive lever 78. The elongated slot 162 also receives the bushing 98 so that the blocking tab 152 may experience limited vertical motion similar to the limited vertical motion which can be experienced by the latch slide 92. The other end of the drive pin 86 is received within the slot 164 formed in the first planar portion 158. The second planar portion 160 of the blocking tab 152 protrudes through a passageway or opening 168 formed through the door 22 so that its hole 166 is positioned in front of the front surface of the door 22. If the drive shaft 74 is rotated clockwise, as viewed in FIG. 3, not only does the latch slide 92 move upwardly, as described above, but also the blocking tab 152 moves upwardly due to the action of the drive pin 86 on the slot portion 164*a*. Upward movement of the blocking tab 152 may continue until the latch slide 92 experiences its maximum amount of upward movement, specifically, that amount of upward movement which permits the latch block 132 to prevent downward movement of the latch arm 108 under the influence of the spring 116. Once the latch slide 92 is held in its uppermost position by the latch block 132, the blocking tab 152 is also held in its uppermost position (FIGS. 7, 7*a* and 11*b*) and cannot move back down to the position shown in FIGS. 2, 3, and 11*a* until the latch block 132 is moved out of the path of the latch arm 108.

Figure 11A:
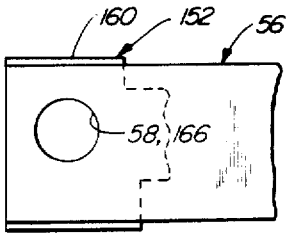
FIGS. 11*a*–11*d* depict the relative positions of a locking staple which forms a portion of the upper latch engageable member depicted in FIG. 9*a* and the blocking tab depicted in FIGS. 5, 5*a* and 5*b* during various stages of manipulation of the door shown in FIG. 1 and of the latch of the present invention.

As already described, when the door 22 is moved to its fully closed position, the projecting member 48 protrudes through the opening 150 in the cover plate 120. This protrusion of the projecting member 48 is effective to move the latch block 132 out of the path of the latch arm 108 to permit the spring 116 to move both the latch slide 92 and the blocking tab 152 to their lowermost positions, as shown in FIGS. 2, 3, and 11*a*. Full closure of the door 22 also causes the locking staple 56 to move through a notch 170 formed in the plate-like member 124 of the cover plate 120 and through the passageway 168 which is aligned with the notch 170. Full closure of the door 122 brings the locking staple 56 into adjacency with the second planar portion 160 of the blocking tab 152.

When the door 22 is fully closed and latched due to entry of the latch arm 108 through the aperture 54 in the projecting member 48, the second planar portion 160 of the blocking tab 152 assumes the position depicted in FIGS. 2, 3 and 11*a*. In this position, the hole 166 formed through the second planar portion 160 is aligned with the hole 58 formed through the locking staple 56. Accordingly, the shackle 154 of the padlock 156 may be inserted through both holes 58 and 166, as shown in FIG. 2. Insertion of the shackle 154 through the holes 58 and 166 prevents upward movement of the blocking tab 152. Because the blocking tab 152 cannot move upwardly when the shackle 154 is inserted into the holes 58 and 166, the drive pin 86 and, accordingly, the drive lever 78 and the drive shaft 74 cannot rotate. Thus, with the shackle 154 in place in the holes 58 and 166, rotation of the drive shaft 74 cannot be effected and, accordingly, the latch arm 108 cannot be removed from the aperture 54 through the projecting member 48. Additionally, the shackle 154 abuts the front surface of the door 22 which thus acts as a hasp . As a further consequence, then, the door 22 cannot be unlatched for opening movement and is locked in its fully closed position.

Assuming the shackle 154 to be in place in the holes 58 and 166, the padlock 156 may be unlocked and the shackle 154 may be removed from such holes 58 and 166. Following this removal, the drive shaft 74 may be rotated (counterclockwise in FIG. 2 and clockwise in FIG. 3) to move the latch slide 92 upwardly and, thus, remove the latch arm 108 from the aperture 54. Upward movement of the latch slide 92 is accompanied by upward movement of the blocking tab 152. Assuming rotation of the drive shaft 174 to continued until the latch block 132 moves into the path of and beneath the latch arm 108, the latch slide 92 now remains in its uppermost position, as does the blocking tab 52. In the uppermost position of the blocking tab 152, the hole 166 and the second planar portion 160 thereof is moved out of vertical alignment with the hole 58 in the locking staple 56. Further, not only are the holes 58 and 166 not aligned (see FIG. 11*b*), but also each hole is partially blocked by the surface of the adjacent member 56 or 160 so that the shackle 154 may not now be inserted into either hole 58 or 166. The holes 58 and 166 do not become realigned until the latch block 132 has been moved out of the path of the latch arm 108 and the latch arm 108 has re-entered the aperture 54. Realignment of the holes 58 and 166 is depicted in FIG. 11*a*. Assuming the padlock 166 to have been removed and the latch arm 108 to have been withdrawn from the aperture 54, the door 22 may be moved to the open position. As already indicated, upon full reclosure of the door and removal of the latch arm 108 from the aperture 54, the shackle 154 of the padlock 156 may again be reinserted into the holes 58 and 166 to lock the latch 20 and the door 22. When the door 22 is moved to the open position, not only is the projecting member 48 moved away from the opening 150 in the latch cover plate 120, but also, the locking staple 56 is withdrawn from the opening 168 and the notch 170 and is no longer in adjacency with the blocking tab 152.

Assume now that following movement of the door 22 to the open position, a worker inserts the shackle 154 of the padlock 156 into the hole 166 formed through the blocking tab 152. This insertion is made possible by the fact that the locking staple 56 is no longer adjacent to the blocking tab 152. Should such insertion of the shackle 154 occur, an attempt to fully reclose the door 22 will be prevented due to abutment between the shackle 154 and the locking staple 56 as the latter moves through the opening 168 in the door 22. See FIG. 11*c*. The inability of the worker to fully reclose the door 22 serves as an alert to remove the padlock 156 and its shackle 154 and to fully reclose and relatch the door before reinsertion of the shackle 154 into the holes 58 and 166.

Assume now that a worker unlatches and opens the door 22 in a manner described previously wherein the drive shaft 74 is rotated sufficiently to remove the latch arm 108 from the aperture 54, but is permitted to be returned to its normal position by the spring 116 without having moved sufficiently upwardly to permit the latch block 132 to move under and into the path of the latch arm 108. In this condition of the latch 20, if the worker does not insert the shackle 154 into the hole 166, interference between the projecting member 48 and the finger 104 will prevent full closure of the door 22, as described previously. If, on the other hand, the worker does insert the shackle 154 into the hole 166, full closure and latching of the door will be prevented by both the last-mentioned interference, as well as by the interference between the shackle 154 and the locking staple 56 as the latter attempts to move through the passageway 168 in the door 22. See FIG. 11*d*. Thus, again, even if the latch 20 is not fully operated in unlatching the door 22, and whether or not the shackle 154 is placed in the hole 166, the worker is given a definite, sensible indication that some manipulation of the latch 20 (or removal of the padlock 156) must be effected before full closure and latching of the door 22 can be achieved.

Figure 11B:
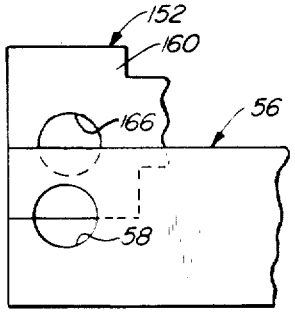
Figure 11C:
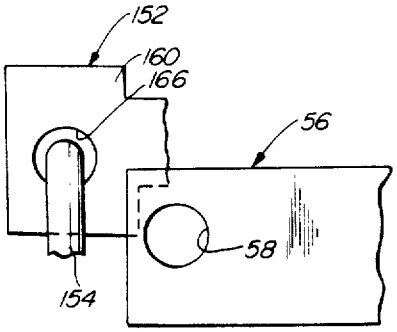
Figure 11D:
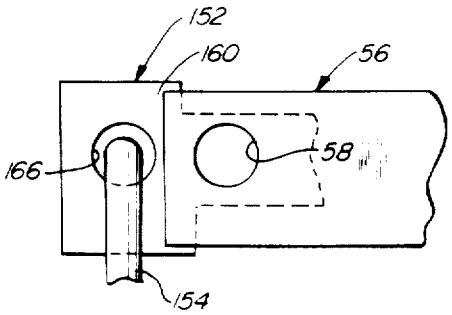

In alternative embodiments, the function of the blocking tab 152 may be performed by the latch slide 92. Specifically, the latch slide 92 may include a portion similar to the portion 160 with the hole 166 therethrough. The portion 160 would, as described above, protrude through the passageway 168 when the door 22 is fully closed. The hole 166 would, at this time, be aligned with the hole 58 in the locking staple 56 if the latch slide 92 is in its lowermost position. The holes 58 and 166 would be misaligned if the latch slide 92 is in its uppermost position. To insure that a lock shackle 154 is not insertable into the hole 58 when the holes 58 and 166 are misaligned, the blocking tab 152 may include a solid portion replacing the portion 160 with the hole 166. This solid portion would simply overlie and block the hold 58 when the blocking tab 152 is in its uppermost position. This arrangement obviates the necessity of precisely locating the locking staple 56 and the portion 160 to achieve the relative positions thereof as shown in FIG. 11*b*.

Figure 10A:
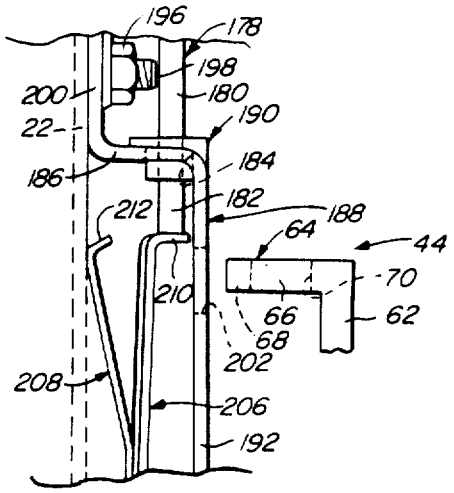
FIGS. 10*a* and 10*b* are enlarged views of a lower portion of the latch depicted in FIG. 7 taken at different times during the operation thereof.
Figure 10B:
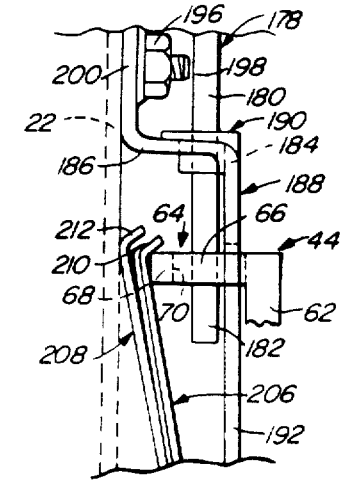

If it is desired that the fully closed door 22 be latched at two points, for example, at its top and bottom, the latch 20 may also include the apparatus depicted in FIGS. 7, 10*a*, and 10*b*. Specifically, connected to the elongated portion 94 of the latch slide 92 by appropriate connectors 172 may be an elongated connecting link 174. The connecting link 174 may be as long as desired and, in the example given where door 22 is to be latched at both its top and bottom, the connecting link 174 is nearly as long as the door 22 is tall. Connected by appropriate connectors 176 to the lower free end of the connecting link 174 is a lower slide latch 178. The lower slide latch 178 comprises an elongated member 180 which terminates at its lower end in a lower latch arm 182. The member 180 passes through an opening 184 through an upper wall 186 of a latch bracket 188. If desired, the opening 184 may contain a bushing bearing 190 to ensure that the metallic member 180 is able to move through the opening 184 without binding. The latch bracket 188 also includes a vertical main wall 192 and a lower wall 194. The latch bracket 188 is attached to the rear surface of the door 22 by appropriate fasteners, such as nuts 196, which are run onto threaded studs 198 attached to the rear surface of the door 22 after such studs 198 are passed through holes (not shown) formed in flanges 200 on the upper and lower walls 186 and 194 of the latch bracket 188. The main wall 192 of the latch bracket 188 contains an opening 202 which serves a function similar to that served by the opening 150 in the plate-like member 124 of the cover plate 120.

The lower wall 194 of the latch bracket 188 contains an aperture 204 which serves a function similar to the aperture 148 in the flange 118 of the cover plate 120. A latch block 206, which is similar to the latch block 132, and a latch spring 208, which is similar to the latch spring 134, have respective hooks 210 and 212 oppositely formed at the ends thereof. The hooks 210 and 212 are similar to the hooks 136 and 146. The latch block 206 and the latch spring 208 are positioned between the main wall 192 of the latch bracket 198 and the rear surface of the door 22 in a manner similar to the positioning of the latch block 132 and the latch spring 134 between the cover plate 120 and the rear surface of the door 22. Specifically, one hook 210 and the latch block 206 and one hook 212 on the latch spring 208 are inserted through the aperture 204 in the lower wall 194 so that the latch spring 208 is positioned between the rear surface of the door 22 and the latch block 206. The latch spring 208 applies a biasing force to the latch block 206, tending to move the latch block 206 toward the opening 202 and into the path of movement of the lower latch arm 182. With the elements positioned as shown in FIG. 7, the hook 210 on the upper free end of the latch block 206 has moved toward the opening 202 and blocks the lower latch arm 182 from moving downwardly. Thus, in FIG. 7, the latch block 132 prevents the latch arm 108 from moving downwardly and the latch block 206 prevents the lower latch arm 182 from moving downwardly.

The latch block 206 is moved out of the path of the lower latch arm 182 by the lower latch engageable member 44 in a manner similar to the movement of the latch block 132 out of the path of the latch arm 108 by the upper latch-engageable member 42. The lower latch engageable member 44 moves through the opening 202 in the main wall 192 of the latch bracket 188 when the bottom of the door 22 moves to a fully closed position. This movement of the door 22 causes the portion 64 of the lower latch-engageable member 44 to abut the latch block 206 moving it against the bias of the latch spring 208 toward the rear surface of the door 22 and out of the path of the lower latch arm 182. As the latch block 206 moves out of the path of the lower latch arm 182, the spring 116 moves both the latch slide 92 and the connecting link 174 downwardly. Downward movement of the connecting link 174 moves the lower latch slide 178 and the lower latch arm 182 downwardly so that the lower latch arm 182 enters the aperture 70 in the lower latch engageable member 44. This movement of the lower latch arm 182 positively latches the bottom of the door 22 in its fully closed position.

In typical construction, an attempt will be made to configure and position the latch arms 108 and 182 and the latch blocks 132 and 206 so that upon appropriate rotation of the drive shaft 74, both latch slides 92 and 178 will move out of the way of the latch blocks 132 and 206 at the same time. However, due to manufacturing tolerances, it may be that one, but not both, of the latch blocks 132 and 206 will move into the path of and prevent movement of its respective latch arm 108 and 182 while the other latch block 206 or 132 is unable to so move. The latch blocks 132 and 206 are made sufficiently robust so that if either one of them blocks the movement of its respective latch arm 108 or 182, both latch slides 92 and 178 and the connecting link 174 are prevented from moving downwardly under the action of the spring 116 on the latch slide 92. Similarly, if both latch blocks 132 and 206 do move into the path of their respective latch arms 108 and 182 following sufficient rotation of the input shaft 74, but upon an attempt to close the door 22 only one of the latch engageable members 42 or 44 is sufficiently inserted through its respective opening 150 or 202 to move its respective latch block 132 or 206 out of the path of the respective slide 92 or 178, the other latch block 206 or 132 is sufficiently robust to prevent movement of both latch slides 92 and 178 and the connecting link 174.

Since either one of the latch blocks 132 or 206 is sufficient to prevent movement of the latch arms 108 and 182, blocking action by either one of them prevents downward movement of the blocking tab 152 and, accordingly, prevents insertion of the shackle 154 of the padlock 156 through the holes 58 and 166. Thus, unless both latch blocks 132 and 206 release their respective latch arms 108 and 182 for downward movement, the latch 20 cannot be secured by the padlock 156 and the worker is given a definite positive indication that the door 22 is not fully closed and latched at both of its latch points.

If latching of the door 22 at three points is desired, a hook member (not shown) may be secured to the connecting link 174 near the vertical mid-point of the door 22. The hook member may engage an appropriate member (not shown) attached to the dividing wall 30 when the latch arms 108 and 182 and the connecting link 174 are in their lowermost positions.

Referring to FIG. 8, washers 213, spacers 214, and bushings 215 may be located as appropriate on the drive shaft 74 between the polygonal head 76 and the front surface of the door 22, between the blocking tab 152 and the rear surface of the door 22, between the blocking tab 152 and the drive lever 78, between the latch slide 92 and the drive lever 78, and between the latch slide 92 and the cover plate 120. The entire assembly may be held together by a split washer 216 fitted into a groove 217 in the drive shaft 74. The split washer 216 may rest against a bushing 218 which surrounds the drive shaft 74 and passes through the cover plate 120. Similar washers 213 and 214 may be located on the threaded stud 100 between the blocking tab 152 and the latch slide 92 and between the latch slide 92 and the cover plate 120. A nut 219 may be run onto the stud 100 from the outside of the cover plate 120.

Referring now to FIGS. 1, 2, 7, 7*a* and 8, additional features of the latch 20 are described. Preferably, mounted to the front surface of the door 22 is a walled member or pocket 220. In preferred embodiments, the pocket 220 has two side walls 222 and a top wall 224, all joined to a front wall 226. The portion of the pocket 220 below and parallel to the top wall 224 is left open. The pocket 220 may be attached to the front surface of the door 22 in any convenient fashion, such as by the use of one or more appropriate bolts 228 and nuts 230 (see FIG. 8). The bolts 228 may pass through a rear wall 232 of the pocket 220 and through the door 22. As best shown in FIG. 2, the pocket 220 is made sufficiently large to encompass and cover the passageway 168 through the door 22, the second planar portion 160 of the blocking tab 152, and the locking staple 56, when the door 22 is in the fully closed position. The pocket 220 also preferably encompasses the portion of the drive shaft 74 running between the polygonal head 76 and the point of passage of the drive shaft 74 through the hole 77 in the door 22. The enclosing of the pocket 220 on all sides, except for the bottom, protects the drive member 72, the second planar portion 160 of the blocking tab 152, the blocking staple 56, and an emplaced padlock 156 and its shackle 154 from the elements. Obviously, the opening at the bottom of the pocket 220 also facilitates insertion of the shackle 154 through the holes 58 and 166. Preferably, the height of the front wall 226 of the pocket 220 is such that when the padlock 156 is emplaced, both the shackle 154 and the upper portion of the body of the padlock 156 are covered by the front wall 226 of the pocket 220. In this way, it is difficult for a vandal to tamper with the shackle 154. Specifically, because the pocket 220 covers the shackle 154 when the padlock 156 is emplaced, and because the front wall 226 is not too widely separated from the rear wall 232, it is quite difficult, if not impossible, for a vandal to apply a bolt cutter or similar device to the shackle 154 in attempting to remove the padlock 156.

Running between the rear surface of the front wall 226 and the front surface of the rear wall 232 is a metallic cylinder 234. The cylinder 234 surrounds both the polygonal head 76 of the drive member 72 and that portion of the drive shaft 74 within the pocket 220. Preferably, the polygonal head 76 and the inside diameter of the metallic cylinder 234 are so related that the apices of the polygonal head 76 are closely spaced to the inside wall of the metallic cylinder 234. This close spacing prevents the insertion of a socket or similar tool into a well 236 defined by the metallic cylinder 234 unless the socket has the exact shape of the polygonal head 76. Stated differently, if an unauthorized person attempts to insert a socket other than one properly matching the polygonal head 76 into the well 236, there will be insufficient space between the apices of the polygonal head 76 and the inside wall of the metallic cylinder 234 to grasp the polygonal head 76.

To further obviate unauthorized tampering or attempts to manipulate the drive member 72, the polygonal head 76 is preferably recessed below the front surface of the front wall 226 and is maintained some distance within the well 236 defined by the cylinder 234. This recessing of the polygonal head 76 not only aids in preventing all but a properly shaped socket from being inserted into the well 236 to engage the head 76, but also prevents manipulation of the polygonal head 76 with a pliers or similar device.

The polygonal head 76 may be a regular pentagon. Since pentagonal sockets are not common and are somewhat difficult to obtain, this configuration of the polygonal head 76 makes it even more difficult for an unauthorized person to manipulate the drive member 72 to gain unauthorized access to the enclosure 24. This prevention of the unauthorized entry into the enclosure 24 is especially important where, as in preferred embodiments hereof, the enclosure 24 houses electrical gear.

Some protection against opening of the door 24 by unauthorized persons is provided where the door 24 is latched closed by the latch 20 but the padlock 156 has not been emplaced in the locking staple 56 and the locking tab 152. Assuming the unauthorized person does not possess a socket which is capable of engaging the polygonal head 76, an attempt might be made to move the blocking tab 152 upwardly. If the slot 164 included only the portion 164*a*, such an attempt might rotate the drive lever 78 and the drive pin 86, thereby raising the latch slide 92 and the connecting link 174 sufficiently to unlatch the door 24. The slot portion 164*b* prevents this. Specifically, after the blocking tab 152 is raised a slight amount, the drive pin 86 enters the portion 164*b*. Thereafter, further upward movement of the blocking tab 152 is prevented by the jamming of the drive pin 86 in the portion 164*b*. This jamming prevents sufficient rotation of the drive lever 78 to unlatch the door 24.

The drive member 72 may be replaced by one having an internal keyoperated locking mechanism (not shown). In this event, the drive member 72 may or may not include the polygonal head 76. In the former case, the locking mechanism requires unlocking before a socket engaging the head 76 can rotate the drive member 72. in the latter case, rotation of the drive member 72 may be achieved with a key used to unlock the locking mechanism. Other members, such as rotatable or slidable handles, may be used in place of the drive member 72 to operate the latch 20. Further, as should be obvious, the pivotable latch blocks 132 and 206 and the flat latch springs 134 and 208 may be replaced by functional equivalents, such as slidable latch blocks (not shown) and compression springs (not shown), respectively.

Figure 12:
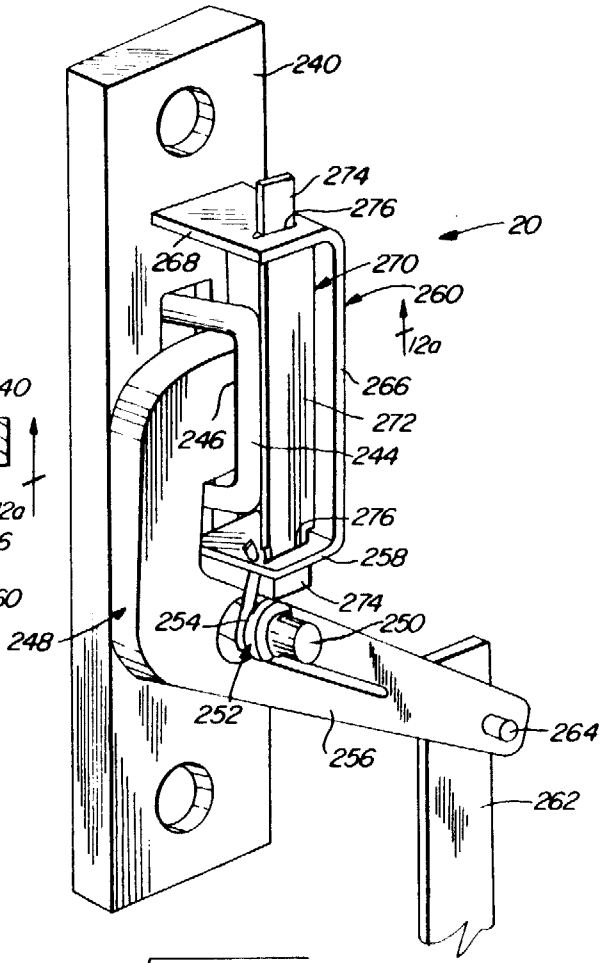
FIG. 12 is a perspective view of an alternative embodiment of the latch of the present invention.
Figure 12A:
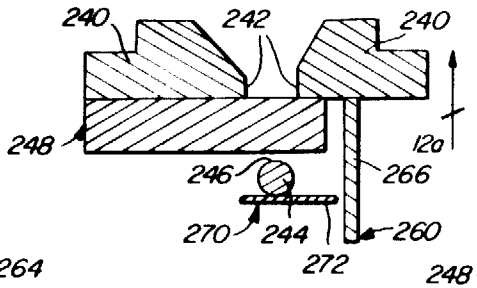
FIG. 12*a* is a sectional view of the alternative embodiment of the latch of the present invention taken along line 12*a*—12*a* in FIG. 12.
Figure 13:
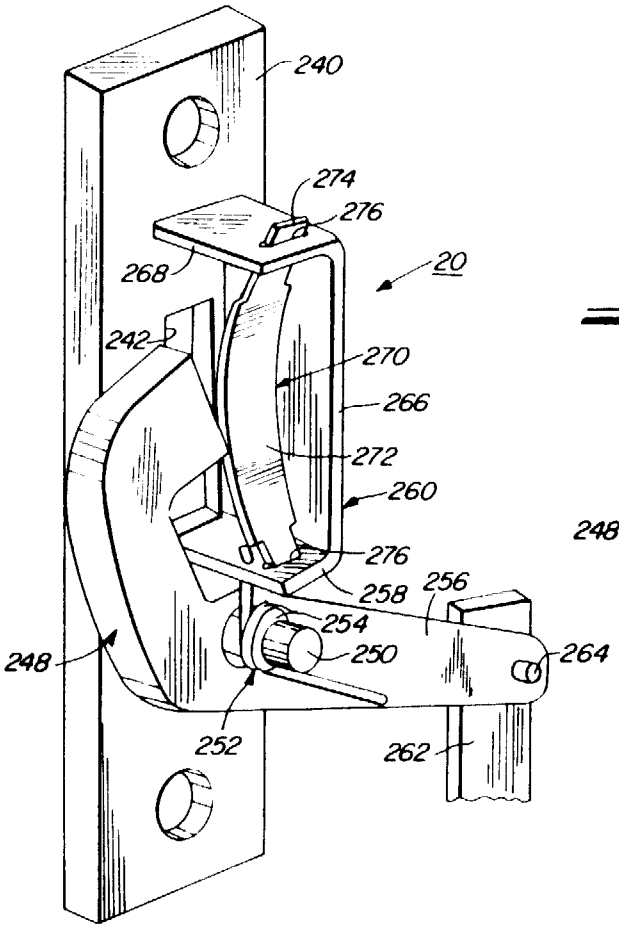
FIG. 13 is a perspective view of the latch depicted in FIG. 12 at a different time during the operation thereof.

In the embodiments of the present invention thus far described, the door 22 carries with it a majority of the elements forming the latch 20—at a location previously defined as the "latching site"—while the door frame 25, 30, 36, 38 has associated therewith only the upper and lower latch-engageable members 42 and 44. FIGS. 12, 12*a* and 13 represent an alternative embodiment in which the majority of elements of the latch 20 are carried by the door frame—at which the "latching site" is located—and a minimum of elements are carried by the door 22.

Referring first to FIG. 12, a portion 240 of the door frame, which may constitute a portion of or be a member attached to the dividing wall 30, as shown in FIG. 1, contains an opening 242. Through the opening 242, when the door 22 (not shown in FIG. 12) is fully closed, protrudes a projection such as a projecting member 244 which may be a U-shaped staple. The projecting member 244 is attached as convenient to the rear surface of the door 22. An opening 246 or other engageable feature is defined by the projecting member 244. The door 22 is latched in its fully closed position by engagement between the projecting member 244, protruding through the opening 242, and a latch arm 248, which is pivoted on a shaft 250 mounted to the rear surface of the door frame portion 240. The latch arm is biased toward the position shown in FIG. 12 by a spring 252, a central wound portion 254 of which may surround the shaft 250. The ends of the spring are respectively connected to an elongated portion 256 of the latch arm 248 and to a lower flange 258 of a latch bracket 260.

In the position shown in FIG. 12, the latch arm 248 enters the opening 246 to prevent the projecting member 244 from being withdrawn from the opening 242 and, thus, preventing the door 22 from being opened. In order to unlatch the door 22 and permit its movement to the open position, an operating arm 262 pivotally connected by a pin 264 to the elongated portion 256 of the latch arm 248 is moved upwardly. Upward movement of the operating arm 262 may be achieved by any convenient type of operating handle located on the outside of the enclosure 24 (not shown in FIG. 12). Upward movement of the operating arm 262 pivots the latch 248 on the shaft 250 to remove the latch arm 258 from the opening 246, as shown in FIG. 13, thus freeing the projecting member 244 for withdrawal from the opening 242 and permitting the door 22 to be opened.

The latch bracket 260 includes a vertical main wall 266 and a top flange 268. The latch bracket 260 may be connected to the rear surface of the door frame portion 240 by welding or the like.

Extending between the flanges 258 and 268 of the latch bracket 260 is a flat spring 270. The flat spring 270 includes a main body portion 272 and decreased width end portions 274. The spring 270 is held to the latch bracket 260 by insertion of the end portions 274 into respective slots 276 in the flanges 258 and 268. The spring 270 is manufactured and/or treated so that is attempts to assume the bowed configuration shown in FIG. 13. The spring 270 is mounted to the latch bracket 260 in such a manner that when it is in the bowed configuration depicted in FIG. 13, it lies on the path taken by the projecting member 244 when such protrudes through the opening 242 and also lies on the path of movement of the latch arm 248.

Assuming that the door 242 is latched (FIG. 12), opening the door 22 is achieved as discussed above. Specifically, the operating arm 262 is moved upwardly to remove the latch arm 248 from the opening 246 in the projecting member 244, thus permitting removal of the projecting member 244 from the opening 242 in the door frame portion 240 and opening of the door 22. Upon both removal of the latch arm 248 from the opening 246 and movement of the projecting member 244 out of the opening 242, the spring 270, which is held in the configuration shown in FIG. 12 by abutment between it and the projecting member 244, assumes the bowed configuration depicted in FIG. 13. In this bowed configuration, the spring 270 prevents the latch arm 248 from being returned to the position shown in FIG. 12 under the influence of the spring 252. Only if the door 22 is fully closed so that the projecting member 244 fully protrudes through the opening 242 is the spring 270 moved out of the bowed configuration depicted in FIG. 13 and back to the straight configuration depicted in FIG. 12. As the spring 270 is moved to its straight configuration, it moves out of the path of the latch arm 248 which may, under the action of the spring 252, reenter the opening 246 in the projecting member 244.

As with the first embodiment of the latch 20 described previously, it may be possible because of manufacturing tolerances to move the latch arm 248 sufficiently to permit the projecting member 244 to be removed from the opening 242 and yet not move the latch arm 248 sufficiently to permit the spring 270 to assume the bowed configuration shown in FIG. 13. Should such occur, the spring 252 returns the latch arm 248 to the position shown in FIG. 12 and blocks the spring 252 from assuming the bowed configuration. In this event, a subsequent attempt to reclose the door 22 will result in the latch arm 248 blocking the full passage of the projecting member 244 through the opening 242. Accordingly, the operator manipulating the door will be made aware of the fact that the operating arm 262 must be moved upwardly to move the latch arm 248 a sufficient amount to permit the projecting member 244 to re-enter and pass through the opening 242. As should be obvious, although only one such latch point is depicted in FIGS. 12 and 13, as with the first described embodiment of the present invention, additional latch points may be provided. Such additional latch points may include additional latch arms 248, all of which may be moved by a common operating arm 262.

We claim:

1. A lockable door latch for holding a door closed, the door being associated with an enclosure such that the enclosure is inaccessible when the door is closed and accessible when the door is opened, the latch comprising:

at least one projection associated with the enclosure;

a latching arm associated with each projection for engaging its associated projection to latch the door when it is closed;

biasing means associated with each latching arm for biasing such latching arm towards its respective projection;

selective moving means associated with the door for moving each latching arm against its respective biasing means to disengage each respective projection to unlatch the door;

a latching arm blocking member associated with each latching arm for blocking each such latching arm from engaging its respective projection except when the door is closed;

a passageway through the door;

a locking staple associated with the enclosure which protrudes through the passageway when the door is closed for receiving a lock shackle therein; and a shield means for preventing such reception of the lock shackle when the door is not closed.

2. A lockable door latch for holding a door closed, the door being associated with an enclosure such that the enclosure is inaccessible when the door is closed and accessible when the door is opened, the latch comprising:

at least one projection associated with the door;

a latching arm associated with each projection for engaging its associated projection to latch the door when it is closed;

biasing means associated with each latching arm for biasing such latching arm towards its respective projection;

selective moving means associated with the enclosure for moving each latching arm against its respective biasing means to disengage each respective projection to unlatch the door;

a latching arm blocking member associated with each latching arm for blocking each such latching arm from engaging its respective projection except when the door is closed;

a passageway through the door;

a locking staple associated with the enclosure which protrudes through the passageway when the door is closed for receiving a lock shackle therein; and a shield means for preventing such reception of the lock shackle when the door is not closed.

3. A system comprised of latch and lock subsystems for holding a door or cover closed, the door or cover being movable toward and away from an area, the door or cover being adjacent to and rendering inaccessible the area when in a closed position, and being away from the area when in an open position to render the area accessible, the latch subsystem comprising:

a projection mounted in or near the area, the projection being adjacent to the door or cover at a latching site thereof when the door or cover is in the closed position and being remote from the door or cover and the latching site when the door or cover is in the open position;

an arm mounted on the door or cover for movement toward and away from the latching site when the door or cover is in the closed position to, respectively, engage and disengage the projection, whereby such engagement holds the door or cover in the closed position and such disengagement frees the door or cover for movement to the open position;

biasing means mounted on the door or cover for biasing the arm for movement toward the latching site;

selective moving means mounted on the door or cover for selectively moving the arm against the biasing means away from the latching site; and movable blocking means mounted on the door or cover and biased for movement to a blocking position whereat the arm is blocked from movement toward the latching site, the blocking means (a) being held out of its blocking position by the projection when the projection is positioned at the latching site, and (b) moving to its blocking position if the projection is not positioned at the latching site and the arm has moved away from the latching site;

and the lock subsystem comprising:

a passageway through the door or cover;

a locking staple mounted in the area which protrudes through the passageway and beyond the door or cover when the door or cover is in its closed position, the locking staple having a first aperture therethrough for receiving a shackle of a lock therein, the door or cover functioning as a hasp when it is closed and the lock shackle is received in the locking staple; and preventing means responsive to the blocking of the arm by the blocking means for preventing such reception of the lock shackle by the locking staple.

4. The system as claimed in claim 3, further comprising a plurality of latch subsystems for holding the door or cover in the closed position at a plurality of respective latch sites, wherein each of the arms is interconnected such that they are moved in common by the selective moving means, and each of the projections must hold its respective blocking means out of its blocking position before the arms can move into their respective latching sites and engage their respective projections to hold the door or cover in its closed position.

5. The system as claimed in claim 4, wherein all of the arms are interconnected such that they are biased in common by the biasing means.

6. The system as claimed in claim 4 or 5, wherein:

the preventing means also prevents disengagement of the arms from their respective projections if the lock shackle is received by the locking staple when the door or cover is closed.

7. The system as claimed in claim 6, wherein:

the preventing means further comprises:

a tab adjacent to the locking staple, the tab having a second aperture therethrough which is alignable with the first aperture of the locking staple only when the door or cover is in its closed position so that the second aperture of the tab and the first aperture of the locking staple can simultaneously receive the lock shackle therein only when such apertures are so aligned; and means for interconnecting the tab and the selective moving means so that the second aperture of the tab is moved out of alignment with the first aperture of the adjacent locking staple when the arms are moved away from their respective latching sites, such lack of alignment between the second aperture of the the tab and the first aperture of the locking staple preventing reception of the lock shackle by either thereof, and so that the tab cannot be so aligned with the locking staple if any arm is blocked by its respective blocking means.

8. A system comprised of latch and lock subsystems for holding a door or cover closed, the door or cover being movable toward and away from an area, the door or cover being adjacent to and rendering inaccessible the area when in a closed position, and being away from the area when in an open position to render the area accessible, the latch subsystem comprising:

a projection mounted to the door or cover, the projection being adjacent to the area at a latching site thereof when the door or cover is in the closed position and being remote from the area and the latching site when the door or cover is in the open position;

an arm mounted in or near the area for movement toward and away from the latching site when the door or cover is in the closed position to, respectively, engage and disengage the projection, whereby such engagement holds the door or cover in the closed position and such disengagement frees the door or cover for movement to the open position;

biasing means mounted in or near the area for biasing the arm for movement toward the latching site;

selective moving means mounted in or near the area for selectively moving the arm against the biasing means away from the latching site;

movable blocking means mounted in or near the area and biased for movement to a blocking position whereat the arm is blocked from movement toward the latching site, the blocking means (a) being held out of its blocking position by the projection when the projection is located at the latching site, and (b) moving to its blocking position if the projection is not positioned at the latching site and the arm has moved away from the latching site;

and the lock subsystem comprising:

a passageway through the door or cover;

a locking staple mounted in the area which protrudes through the passageway and beyond the door or cover when the door or cover is in its closed position, the locking staple having a first aperture therethrough for receiving a shackle of a lock therein, the door or cover functioning as a hasp when it is closed and the lock shackle is received in the locking staple; and preventing means responsive to the blocking of the arm by the blocking means for preventing such reception of the lock shackle by the locking staple.

9. The system as claimed in claim 3 or 8, wherein:

the preventing means also prevents disengagement of the arm from the projection if the lock shackle is received by the locking staple when the door or cover is closed.

10. The system as claimed in claim 8, wherein:

the preventing means further comprises:

a tab adjacent to the locking staple, the tab having a second aperture therethrough which is alignable with the first aperture of the locking staple only when the door or cover is in its closed position so that the second aperature of the tab and the first aperature of the locking staple may simultaneously receive the lock shackle therein only when such apertures are so aligned; and means for interconnecting the tab and the selective moving means so that the second aperature of the tab is moved out of alignment with the first aperature of the adjacent locking staple when the arm is moved away from the latching site, such lack of alignment between the second aperature of the tab and the first aperature of the locking staple preventing reception of the lock shackle by either thereof, and so that the tab cannot be so aligned with the locking staple if the arm is blocked by the blocking means.

11. The system as claimed in claim 8, wherein:

the projection defines a feature engageable by one end of the arm, and the blocking means comprises a flat spring having a first configuration in which it bows to lie in the path of movement of the one end of the arm, the flat spring being flexed out of its first configuration to a second configuration by abutment thereagainst of the projection when the door or cover is closed.

12. The system as claimed in claim 11, wherein:

the path of relative movement between the projection and the area and the path of movement of the one end of the arm are generally perpendicular to each other, and the path of movement of the flat spring as it flexes between its first and second configuration is generally parallel to the path of relative movement between the projection and the area.

13. The system as claimed in claim 12, wherein:

the ends of the flat spring are mounted to a wall or enclosure near the latch site so that in its first configuration, the flat spring bows toward the door or cover in a direction opposite that taken by the projection as the door or cover closes, the bowed flat spring lying on the intersection of the paths taken by both the projection and the one end of the arm.

14. The system as claimed in claim 3, wherein:

the projection defines a feature engageable by one end of the arm, and the blocking means comprises a plate mounted to the door or cover for pivoting about one end thereof, the plate having a first position in which the other end thereof lies in the path of movement of the one end of the arm, the plate being pivoted out of its first position to a second position by abutment thereagainst of the projection when the door or cover is closed so that the other end of the plate lies out of the path of movement of the one end of the arm.

15. The system as claimed in claim 14, wherein:

the blocking means further comprises:

a spring acting between the door or cover and the plate to bias the plate toward its first position.

16. The system as claimed in claim 15, wherein:

the paths of movement of the projection relative to the door or cover and the one end of the arm are generally perpendicular to each other, and the path of movement of the other end of the plate as the plate pivots between its first and second positions is generally parallel to the relative path of movement between the projection and the door or cover.

17. The system as claimed in claim 16, wherein:

in the first position of the plate, the other end thereof lies on the intersection of the paths taken by the one end of the arm and by the projection as it moves relative to the door.

18. The system as claimed in claim 3, wherein:

the selective moving means comprises:

a tool-engageable member on the door or cover, manipulation of a tool engaging the tool-engageable member selectively moving the arm.

19. The system as claimed in claim 18, wherein:

the arm, the biasing means and the blocking means are located on a rear surface of the door or cover, and a portion of the tool-engageable member is accessible from a front surface of, and passes through, the door or cover, and which further comprises:

interconnecting means for moving the arm in response to manipulation of the tool-engageable member.

20. The system as claimed in claim 19 wherein:

manipulation of the tool-engageable member results in rotation thereof, and the portion of the tool-engageable member accessible from the front surface of the door or cover is a polygon which is engageable and rotatable by a similarly configured tool.

21. The system as claimed in claim 20, which further comprises:

an enclosure mounted to the front surface of the door or cover having one open side, and an open-ended cylinder within the enclosure and extending between a hole in the front surface of the door or cover and a hole through a facing wall of the enclosure, the cylinder defining a well within which the tool-engageable member is located, the polygonal portion of the tool-engageable member being engageable and rotatable by a similarly configured tool when such tool is inserted into the well through the hole in the facing wall of the enclosure, an end of the tool-engageable member distal from the polygonal portion thereof extending through the hole in the front surface of the door for association with the selective moving means at the rear surface of the door.

22. The system as claimed in claim 21, wherein:

the polygonal portion of the tool-engageable member is recessed below the face of the cylinder, and the clearance between the vertices of the polygonal portion of the tool-engageable member and the inside of the cylinder is such that a dissimilarly configured tool is unable to fit into the well and sufficiently engage the polygonal portion to readily rotate the tool-engageable member.

23. The system as claimed in claim 22, wherein:

the passageway communicates with the enclosure such that the locking staple protrudes through the passageway, beyond the door or cover and into the enclosure when the door or cover is closed for receiving the lock shackle therein, the lock shackle being insertable into the enclosure through the open side thereof, wherein the lock shackle is contained within the enclosure, whereby tampering with the shackle will be restricted.

24. The system of claim 23, wherein:

the open side of the enclosure faces in a direction such that the locking staple, the tab, the lock shackle simultaneously received by both thereof, and the body of the lock are protected from the elements.

25. The system as claimed in claim 3 or 8, wherein:

with the door in its closed position, the arm disengages the projection when the projection is located at the latching site only after a first predetermined amount of movement of the arm away from the latching site; and the blocking means moves to its first position only if the projection is not located at the latching site and the arm has moved away from the latching site by more than a second predetermined amount, the second predetermined amount being greater than the first predetermined amount, so that movement of the arm away from the latching site by only the first predetermined amount disengages the arm from the projection to permit opening of the door or cover and movement of the projection away from the latching site, and permits the biasing means to move the arm back toward the latching site, thereby preventing the blocking means from moving to its first position, whereby upon a subsequent attempt to close the door the projection is unable to move to the latching site.

26. The system as claimed in claim 25, further comprising:

means responsive to the inability of the projection to move to the latching site for preventing the reception of the lock shackle by the locking staple.

* * * * *

UNITED STATES PATENT AND TRADEMARK OFFICE

CERTIFICATE OF CORRECTION

PATENT NO. : 4,489,966

DATED : December 25, 1984

INVENTOR(S) : Emmett R. Beebe, et al

It is certified that error appears in the above-identified patent and that said Letters Patent are hereby corrected as shown below:

Column 3, line 13, "door is or cover closed." should be --door or cover is closed--.

Column 4, line 4, "5a" should be --5a,--.

Column 5, line 26, "from" should be --for--.

Column 5, line 45, "projection" should be --projecting--.

Column 8, line 3, omit "studs".

Column 9, line 34, "as" should be --As--.

Column 10, line 52, "drive 74" should be --drive shaft 74--.

Column 12, line 19, "continued" should be --continue--.

Column 21, line 2, omit "the".

Signed and Sealed this

*Twenty-second* Day of *October 1985*

[SEAL]

*Attest:*

*Attesting Officer*

DONALD J. QUIGG

*Commissioner of Patents and Trademarks—Designate*